United States Patent [19]

Bidwell

[11] Patent Number: 4,779,576

[45] Date of Patent: Oct. 25, 1988

[54] WATER COOLED SCAVENGED CRANKCASE TYPE OTTO INTERNAL COMBUSTION ENGINE

[75] Inventor: Howard Bidwell, Granby, Mass.

[73] Assignee: Stephen Masiuk, Granby, Mass.

[21] Appl. No.: 122,702

[22] Filed: Nov. 19, 1987

Related U.S. Application Data

[62] Division of Ser. No. 25,071, Mar. 12, 1987.

[51] Int. Cl.[4] ..... F02D 19/00

[52] U.S. Cl. ..... 123/25 P; 123/590; 60/617; 60/712

[58] Field of Search ..... 60/712, 617; 123/25 B, 123/25 D, 25 P, 548, 590, 73 R; 184/6.5

[56] References Cited

U.S. PATENT DOCUMENTS

| | | | |
|---|---|---|---|
| 4,122,803 | 10/1978 | Miller | 123/25 C |
| 4,346,675 | 8/1982 | Holliday | 123/25 B |
| 4,599,863 | 7/1986 | Marttila | 60/620 |
| 4,640,234 | 2/1987 | Olsson et al. | 123/25 C |

*Primary Examiner*—Charles J. Myhre
*Assistant Examiner*—David A. Okonsky
*Attorney, Agent, or Firm*—Ross, Ross & Flavin

[57] ABSTRACT

In an internal combustion type engine having a piston disposed within a cylinder, a plurality of ceramic cylinder inner surface sections are provided for covering surfaces of the cylinder chamber and the piston which are directly exposed to the ignited combustion gases as the piston travels through its stroke. Same are for the protection of the metal structure of the engine from exposure to the heat generated within the cylinder.

6 Claims, 2 Drawing Sheets

WATER COOLED SCAVENGED CRANKCASE TYPE OTTO INTERNAL COMBUSTION ENGINE

This is a division of application Ser. No. 07/025,071, filed Mar. 12, 1987.

This invention relates to new and novel methods and apparatus for improving the use and overall efficiency of the water-cooled, hermetically-sealed, scavenged, crankcase-type Otto internal combustion engine.

It is distinguished by the eliminating of the conventional means of lubrication consisting, as known, of adding a lubricating oil to the fuel in the fuel tank, usually at the rate of one pint of oil for each fivce gallons of gasoline, resulting in an objectionable hazy blue smoke in the exhaust, which was also an extra troublesome task for the average car owner, or operator in having to add oil to the fuel.

It is further distinguished by the feature of utilizing the reclaimed heat from the engine cylinder cooling water system in part with the reclaimed heat from the exhaust tail pipe system (both of which are normally wasted) for the purpose of generating steam which is subsequently fed directly into the conventional air filtered carburetted air/fuel mixture flow intake manifold.

A flow of steam-atomized graphite and tallow enriched high viscous oil of (40 A.S.E. grade) in vapor form is conveyed directly into the engine intake flow manifold by means of which a more effective system for lubricating all of the wearing surfaces within the engine crankcases as well as in all of the cylinders is attached, which system is free of any offensive odors or visible exhaust haze and is more adaptable to higher combustion temperatures.

The invention is further distinguished in that it allows the utilizing of the benefits of the induced steam content of the engine intake to modulate in cylinder ignition combustion temperatures which range above those normal for the practical use of the usual metal parts, particularly during the feeding of hydrogen or oxygen gases into the engine intake manifold.

The invention implements to an advantage the benefits of the thermodynamic characteristics of the in-cylinder steam content to absorb the heat rapidly at the ignited gas combustion instant temperature which absorbed heat is subsequently released in the expansion of the steam during the piston travel prior to the point of exhaust flame release, so as to amplify to a degree the in-cylinder pressure thrust against the piston throughout the downward power stroke which also creates a scavenging effect so as not only to tend to prevent, but also to clear the cylinder volume area of unwanted carbon deposits within the cylinder.

By this invention, it is most significant that it teaches the reducing of engine fuel intake while simultaneously reducing exhaust pollution output (including the oxides of nitrogen) due in part to the steam inflow at the intake manifold that displaces to a degree the volume of ambient air as drawn into the engine intake and decreases the amount of nitrogen intake accordingly, and simultaneously therewith, the feeding of oxygen gas into the engine intake, as generated by reclaimed energy from the engine exhaust flame that replenishes the necessary oxygen for the desired in-cylinder combustion effects and the feeding of hydrogen gas into the exhaust flame jet stream at a venturi tube type inlet connection that materially increases the initial velocity thrust on the outer vaning of an exhaust turbine rotor.

This, in turn, materially increases the reclaimed secondary combustion energy resulting from the subsequent blending of auxiliary heat conditioned air induced into the exhaust flame activity within the confines of opposed rotor and stator reaction type vaning within the turbine rotor housing.

Because of the strong suction effect within the intake manifold, as characteristic of the two-cycle engine, (due to the piston pumping action within the non-vented sealed crankcase, during the piston up-stroke travel) a manual or mechanical variably-adjustable regulating auxiliary air-inlet valve is provided, which is located between the carburetor outlet and intake manifold inlet and may be regulated to suit smooth engine running performance.

The invention is further distinguished by the provision of multi-piece ceramic type in-cylinder lining sections, which include, first, a ceramic cylinder liner section having an exhaust outlet port and a separate air/fuel mixture inlet port, second, a ceramic cylinder head liner section having either a spark plug opening or a fuel injection nozzle opening, and third, a suitable ceramic piston top liner with suitable means for securing same to the piston body, so as to isolate and also to insulate the high temperature combustion gases from the general metal structure of the engine body. That is, the inner surfaces of the cylinder chamber exposed to the ignited gases of combustion during the piston travel through its stroke are covered with ceramic so as to protect the metals therebehind from the excessive generated temperatures.

Because of the simplicity in design of two-cycle engines in having no complicated troublesome cam gear operated poppet type inlet and exhaust valves, no troublesome complicated timing belts and drives, no lubricating splash pool or oil pan, no lubricating oil pump, requiring no frequent oil changes, and no need for a separate cylinder head casting and gaskets to blow or leak, (which often happens in the case of the known four-cycle types) by which in the absence of all the above space consuming complicated troublesome mechanical paraphernalia the four cycle engine is buried under, the early two cycle engines performed remarkably well operationwise, except for the blue smoke haze and its oil to fuel requirement that caused its unpopular use, the two-cycle engine is still much more acceptable, by virtue of its simplicity, to the use of ceramic cylinder linings and the absence of liquid oil lubrication that permit much higher in-cylinder combustion with greater reduced pollution.

Figure 1:
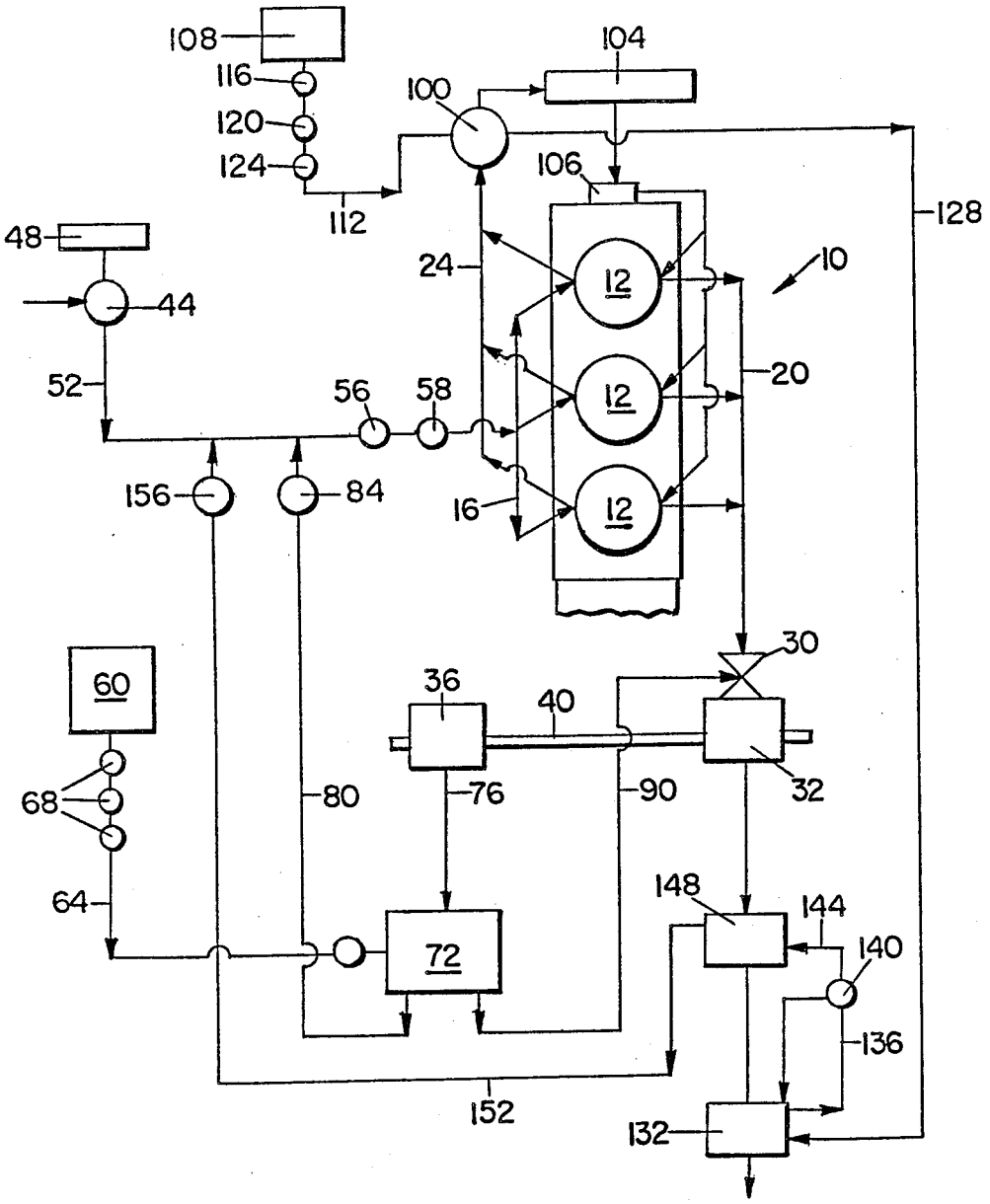
FIG. 1 is a schematic flowline diagram showing the various operatively interconnected components illustrating the basic principles of the invention.

Referring first to the FIG. 1 schematic an engine 10 is seen to comprise a trio of two-cycle engine cylinders 12 having a common intake manifold 16 and a common exhaust manifold 20.

The exhaust from the exhaust manifold is directed via a conduit 28 leading to a venturi 30 and into an air-cooled, exhaust-driven, turbine rotor 32, the exhaust flame impinging directly against the vaning of the rotor and imparting a rotative motion thereto.

An electric generator 36 coaxial with the turbine rotor is driven by an extension of a rotor drive shaft 40.

The air-fuel mixture to the engine intake is drawn from an air filter 48 and cooperant carburetor 44 through a conduit 52.

A strong pumping action of each piston within each crankcase on its respective up stroke leads to a sufficient, if not excessive, intake suction effect so that no supercharger is needed. Rather an auxiliary air inlet device, installed in conduit 52 adjacent to the carburetor outlet and before the intake manifold inlet, serves as an essential necessary accessory for diluting the carbureted fuel mixture with additional air even though manually controlled to engine response, and followed by a one-way valve 58 on the outlet side of which is fitted a rugged fire screen to prevent backfire, but more importantly to prevent any entry of any foreign object being drawn into any one of the crankcases due to the close clearances of the crank and counterweights, known heretofore to cause ruptures in the crankcase housing and to represent major expensive repair problems.

Water is supplied from a reservoir 60, via a conduit 64, along which controls 68 are disposed for a flow to a hydrogen-oxygen generator 72.

Controls 68 may be automatically activated to open positions, upon switching the vehicle ignition to its on position, automatically returning to off positions when the ignition is turned off.

Hydrogen-oxygen gas generator 72, receives its current via line 76 from electric generator 36.

The generator generates hydrogen gas for delivery via hydrogen conduit 80 to conduit 52, passing through a supplementary lubrication means 84 disposed in conduit 80 and generates oxygen gas for delivery via oxygen conduit 90 for delivery to the exhaust line forwardly of the turbine rotor for charge directly into the exhaust flame.

Supplementary lubrication means 84 feeds a dry powdered graphite to the hydrogen gas prior to entry to intake manifold 16.

This arrangement allows an automatic control of the carbureted air/fuel/mixture fed to the intake manifold in consonance with the amount of hydrogen automatically fed to the intake, free of any regularing devices save for the usual throttle means for accommodating to the various engine speed and load conditions.

Water manifold 24 is connected to the water cooling jackets 26 circumscribing each of the cylinders, as will subsequently appear, and the water therefrom passes through the manifold to a heat exchanger 100 and thence to a cooling radiator 104 and on to a water circulation pump 106 same being used to heat via the heat exchanger a relatively low variably-regulated trickle flow of water (preferably distilled) flowing by gravity from a reservoir 108 through a conduit 112 along which a needle type regulating valve 116, a sight feed mechanism 120, and a magnetically-controlled two-position valve 124 are disposed.

In heat exchanger 100, the water is heated to its approximate boiling point before passage via a conduit 128 to a first downstream exhaust pipe heat exchanger 132 for heating the water to a steam condition.

The steam is then passed via a conduit 136 to a steam moisture separator 140 for conversion to dry steam and then by a conduit 144 to a second exhaust pipe heat exchanger 148 for conversion into a superheated steam condition.

From here, the superheated steam is conveyed via a conduit 152 having a hydraulic steam engine lubricator 156 to interconnection with conduit 52 and thence to intake manifold 16.

This arrangement allows the superheated steam to serve as a carrier of a predetermined amount of graphite and tallow-enriched high viscosity oil (grade 40) which is atomized and disposed within the individual crankcases by the agitation of the piston, crank and counterweight action therein.

The rate of lubricant feed is adjustably varied by means of a needle valve in lubricator 156 so as to permit the control of droplets being dispensed at desired spaced intervals.

The finely dispensed graphite carried by the steam flow finds its way into the microscopic pores of the wear surfaces within the crankcases and cylinders and offers advantageous antifriction effects.

The tallow composition tends to prevent the wash-away effects of the lubricant under the encountered high temperature and moisture conditions.

At the same time, the superheated steam at atmospheric pressure gasifies the carbureted air/fuel mixture to a true complete gas within the engine crankcase prior to admission into the cylinders. This allows the gas to be more completely and instantaneously flammable upon ignition, a characteristic lacking in most conventional systems.

Figure 2:
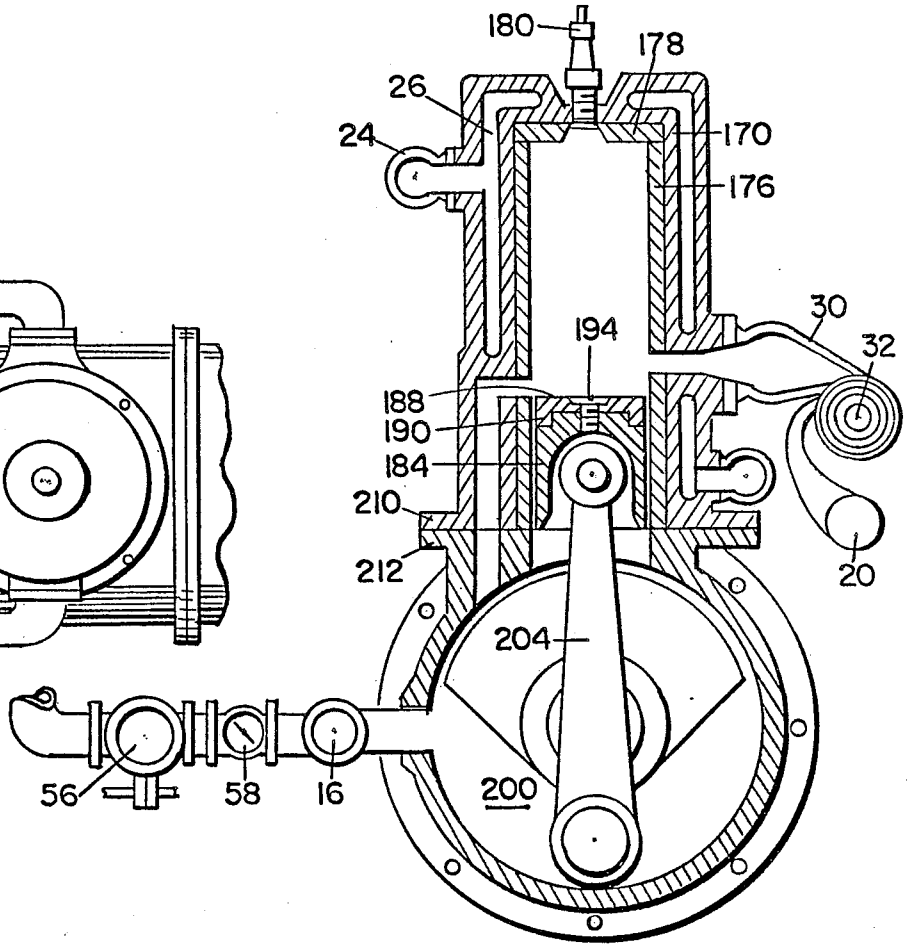
FIG. 2 is a fragmentary sectional view through a two-cycle engine cylinder of the type envisioned in the invention.
Figure 3:
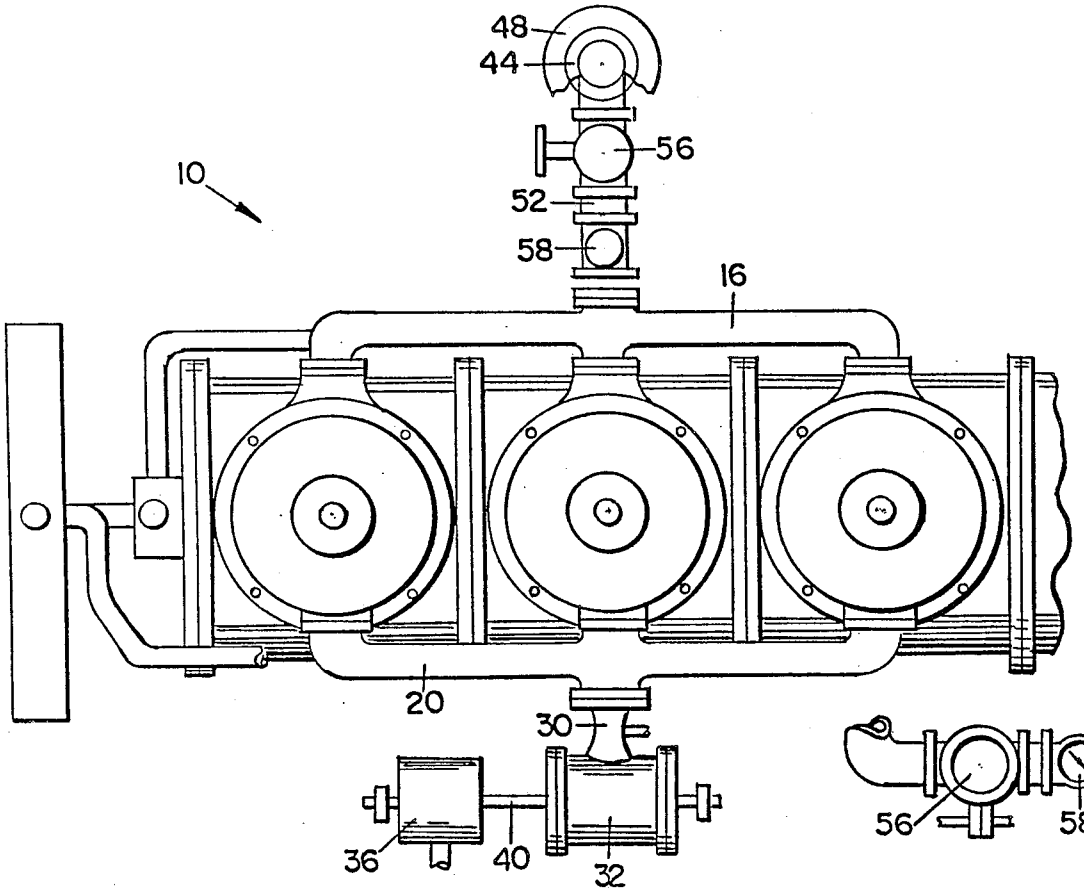
FIG. 3 is a view, in top plan, of a multicylinder arrangement of two-cycle cylinders in a single block as envisioned in the invention.

With reference to the FIG. 2 showing of a water cooled two cycle engine.

The cylinder wall 170 has a ceramic lining 176 and a ceramic lining 178 for the cylinder head with the usual spark plug 180 extending therethrough.

The top of the piston 184 is capped with a ceramic cover 188 which is so configured as to extend as a skirt 190 partially over the side of the piston in an encapsulating manner and is secured to the piston by a plurality of set screws (not shown) well out of the danger of exposure to the flame.

A flat headed set screw 194 may be disposed centrally of the top of the piston for interengaging the ceramic lining and piston.

By means of this three-piece ceramic arrangement, the interior of the cylinder is insured of protection from any higher-than-normal combustion temperatures, especially as may be encountered when hydrogen and/or oxygen gases are exploited. In such cases, the metals of the cylinder walls or the piston itself might not be suited for such temperatures. However, the metallic structures supporting the ceramic components function merely in absorbing the stresses which the ceramic material cannot accommodate to by itself.

The multi-cylinder arrangement of three cylinders, as herein disclosed, is envisioned for normal car or truck use, and these cylinders can be consolidated into a compact single cylinder block casting.

However, the crankcase 200 for each cylinder will remain as a separate chamber so as to dictate the employment of a built-up type of crankshaft 204 which has advantages in the respect to cost of manufacture and/or repair.

When the plural cylinders are cast in a single block form, the intake and exhaust manifolds are shortened.

The cylinder heads are formed of a separate casting for easy removal.

Too, the cylinder block is removable at a common flanged arrangement 210 in which case each crankcase is arranged with a matching flange 212 so as to define a separate chamber.

The ceramic liners are removable and will be free of any securing means when finished to a proper fit for seating within the block casting, thereby being easily removed and replaced when necessary.

The piston will be fitted with the usual piston rings (not shown).

The engine exhaust manifold will be fitted with a venturi type of outlet connection to a turbine rotor housing as exemplified in my copending application.

The superheated steam enters each crankcase at atmospheric pressure where it is compressed before admission to its respective cylinder. It is additionally compressed within the cylinder on the upstroke of the piston to the point of ignition.

During the ignition-combustion activity and the attendant pressure and temperature changes, the thermodynamic properties of the steam allows the steam to augment the thrust force against the piston during its down power stroke by virtue of its expansion force and heat releasing characteristic throughout the travel of the down stroke to the point of exhaust release into the venturi type of exhaust manifold outlet.

By means of the venturi effect, the velocity of the exhausted fire flame mixture is greatly increased in magnitude as it impinges against the vaning of the rotor.

Within the rotor housing, heat conditioned auxiliary fresh air is blended into the exhaust flame so as to excite and sustain an additional secondary combustion activity within the turbine with the result that the unburned hydrocarbons and carbon monoxide gases are further consumed, all as execplified in my copending application. Ser. No. 015,853 filed Feb. 17, 1987.

Maximum heat energy is extracted from the cylinder block via the cooling system while at the same time maximum heat and kinetic energy is extracted from the engine exhaust in the form of secondary combustion as excited and sustained by the introduction of waste heat conditioned auxiliary air being blended into the exhaust flame jet and further fortified and enhanced by either hydrogen or oxygen gases, or both as may be arranged separately or jointly, wholly within the opposed reactionary stator and rotating vaning of the exhaust flame propelled rotor housing, that in turn propells a special electric generator that automatically energizes a hydrogen-oxygen gas generator according to engine load speed operation conditions.

I claim:

1. In a system for a water cooled scavenged crankcase type two-cycle internal combustion engine comprising: a heat reclaimation system for extracting heat from an engine jacket for heating water supplied from an add-on reservoir via a heat exchanger located within the engine cylinder cooling system, the water being subsequently additionally heated by an exhaust pipe type heat exchanger to a superheated steam state and thence conveyed by a conduit to a steam lubricator for adjustably conveying in variably timed spaced succession intervals of regulated droplets of high viscous oil, fortified with added graphite and tallow enrichment lubricant ingredients, and thence conveying such by steam at atmospheric pressusre into an intake manifold which receives a carbureted air/fuel mixture into the crankcase via a manually operated auxiliary air intake device and one way check valve and fire screen, due to suction effect of the piston up stroke action of the piston during engine operation.

2. In the system as claimed in claim 1, including comprising the elimination of adding oil to the engine intake fuel.

3. In the system of claim 2, including the method of regulating manually or otherwise a flow of auxiliary air admitted into the engine intake following carburetting.

4. In the system of claim 3, including the method of admitting a steam flow into the engine intake for the purpose of reducing the volume of air intake to reduce oxides of nitrogen in the engine exhaust.

5. In the system as in claim 1, including the feeding of hydrogen gas into the carbureted air/fuel flow stream below the carburetor and ahead of the one way flow valve for the purpose of increasing combustion energy on ignition within the cylinder, said hydrogen gas being generated by a hydrogen-oxygen generator energized by a special DC electric generator from which the oxygen gas is simultaneously fed to the engine exhaust venturi for increasing the velocity and heat value thereof for additional driving force as may be utilized by the gas generator.

6. In the system as in claim 2, including the method of selectively varying the distribution of hydrogen and oxygen gases between the engine intake and engine exhaust to best accommodate operating economy.

* * * * *